US006622324B2

(12) United States Patent
VanSteenburg et al.

(10) Patent No.: US 6,622,324 B2
(45) Date of Patent: Sep. 23, 2003

(54) HIP BRACE APPARATUS

(75) Inventors: Kip P. VanSteenburg, Sudbury, MA (US); George T. Wong, Chelmsford, MA (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/814,920

(22) Filed: Mar. 22, 2001

(65) Prior Publication Data

US 2002/0157186 A1 Oct. 31, 2002

Related U.S. Application Data

(60) Provisional application No. 60/192,538, filed on Mar. 28, 2000.

(51) Int. Cl.[7] ..... A47B 7/00
(52) U.S. Cl. ..... 5/621; 5/624; 5/610; 128/845
(58) Field of Search ..... 5/621, 623, 624, 5/610, 657; 128/845

(56) References Cited

U.S. PATENT DOCUMENTS

| | | | | |
|---|---|---|---|---|
| 3,823,709 A | | 7/1974 | McGuire | |
| 3,844,550 A | | 10/1974 | McGuire | |
| 3,938,205 A | | 2/1976 | Spann | |
| 4,180,254 A | * | 12/1979 | Lee et al. | 5/621 |
| 4,391,438 A | | 7/1983 | Heffington, Jr. | |
| 4,526,355 A | * | 7/1985 | Moore et al. | 5/624 |
| 4,583,725 A | * | 4/1986 | Arnold | 5/621 |
| 4,624,245 A | * | 11/1986 | Mullin et al. | 5/621 |
| 4,702,465 A | | 10/1987 | McConnell | |
| 4,717,133 A | | 1/1988 | Walsh et al. | |
| 4,840,363 A | | 6/1989 | McConnell | |
| 5,152,024 A | * | 10/1992 | Chrones et al. | 5/609 |
| 5,208,928 A | | 5/1993 | Kuck et al. | |
| 5,239,716 A | | 8/1993 | Fisk | |
| 5,299,334 A | * | 4/1994 | Gonzalez | 5/607 |
| 5,301,221 A | | 4/1994 | Yakubisin | |
| 5,390,383 A | * | 2/1995 | Carn | 128/877 |
| 5,444,882 A | | 8/1995 | Andrews et al. | |
| 5,484,393 A | * | 1/1996 | McCoy | 5/621 |
| 5,489,258 A | * | 2/1996 | Wohnsen et al. | 280/250.1 |
| 5,628,078 A | | 5/1997 | Pennington et al. | |
| 5,774,915 A | * | 7/1998 | Scott et al. | 5/610 |
| 5,941,907 A | | 8/1999 | Augustine | |
| 6,032,309 A | | 3/2000 | Michelson | |
| 6,076,525 A | | 6/2000 | Hoffman | |
| 6,260,220 B1 | * | 7/2001 | Lamb et al. | 5/601 |
| 6,298,507 B1 | | 10/2001 | Clyburn | |
| 6,311,349 B1 | | 11/2001 | Kazakia et al. | |
| 6,315,718 B1 | | 11/2001 | Sharratt | |

OTHER PUBLICATIONS

O.R. Direct, Surgical Table Accessories, *Piece of Mind? Piece of Cake!, Great Products . . . Great Prices*, Fall 1999, 24 pages.

Allen Medical Systems, *Passionate About Positioning*, 1998, 20 pages.

* cited by examiner

*Primary Examiner*—Lynne H. Browne
*Assistant Examiner*—James M. Hewitt
(74) *Attorney, Agent, or Firm*—Barnes & Thornburg

(57) ABSTRACT

A method and apparatus for restraining a patient in a Trendelenburg position include positioning a patient on a patient support surface which is tiltable and includes a head end, a foot end and opposed sides which extend between the head end and the foot end, and engaging a top portion of the patient's hips on either side with padded hip braces configured to engage the top portion of the patient's hips and prevent the patient from sliding toward the head end of the tiltable patient support surface when tilted in the Trendelenburg position.

15 Claims, 6 Drawing Sheets

HIP BRACE APPARATUS

RELATED APPLICATION

The present disclosure is based upon U.S. Provisional Application Ser. No. 60/192,538, filed on Mar. 28, 2000, the complete disclosure of which is hereby expressly incorporated by reference.

BACKGROUND AND SUMMARY

The present invention relates to surgical tables and accessories, and, particularly, to Trendelenburg braces that are used to secure the position of a patient on a patient support surface that is tilted in a Trendelenburg position. More particularly, the present invention is directed to hip brace apparatus that are coupled to surgical tables.

Patients are placed in a variety of positions on surgical tables during surgical procedures in order to optimize access to surgical sites, enhancing surgical outcomes. Numerous products are available for use in conjunction with surgical platforms, tables, and the like to position and secure a patient's limbs or other body parts in an optimal position for the surgeon. These products include headrests and restraints, arm supports, leg holders, shoulder braces, lateral braces and supports, restraints, stirrups, and similar devices.

In the Trendelenburg position, a patient is tilted or inclined such that the patient's feet are at an elevation higher than the patient's head. Patients are sometimes placed in the Trendelenburg position, for example, during abdominal surgery so that the patient's abdominal organs are pushed toward the chest cavity. It is also common for patients to be placed in the Trendelenburg position when surgery is to be performed on the patient's pelvic region.

When a patient is placed in the Trendelenburg position, the patient has a tendency to shift or slide under the force of gravity toward the head end of the surgical table supporting the patient. In addition, during surgical procedures, surgeons may sometimes apply forces to patients with surgical instruments that have a tendency to cause the patients to move. It is desirable, therefore, to have a patient held securely in place on a surgical table during surgery. This is especially true during video surgery, for example, where small movements of the patient are exaggerated on a video monitor due to magnification of the image of the surgical site on the monitor.

The present invention provides hip brace apparatus that are coupled to surgical tables and other patient support devices, and that are adjusted to secure a patient in position when the surgical table is tilted in a Trendelenburg position. The hip brace apparatus preferably includes a hip brace configured with a cupped surface that engages the patient in an area adjacent the iliac crest of the pelvis. An adjustable positioning assembly couples the hip brace to the surgical table and permits the hip brace to be moved into and locked in a number of positions. In preferred embodiments, the shape of the cupped surface is generally complimentary to the shape of a portion of the iliac crest so as to prevent longitudinal movement of the patient toward the head end of the surgical table, and so as to prevent transverse movement of the patient toward the sides of the surgical table. Also, in preferred embodiments, the hip brace includes a base member and padding material covering at least a portion of the base member.

In accordance with an aspect of the present invention, an apparatus for restraining a patient in a Trendelenburg position includes a patient support surface that is tiltable. The patient support surface has a head end, a foot end, and opposed sides that extend between the head end and the foot end. The apparatus further includes a pair of padded hip braces positioned inward from the sides of the patient support at an intermediate location between the head end and foot end of the patient support surface. The pair of padded hip braces preferably engage a top portion of the hips of a patient lying on the patient support surface to prevent the patient from sliding toward the head end when the patient support surface is tilted in a Trendelenburg position.

In accordance with another aspect of the present invention, a method for restraining a patient in a Trendelenburg position includes positioning a patient on a tiltable patient support surface having a head. The method further preferably includes engaging a top portion of the patient's hips with hip braces that are configured to engage the top portion of the patient's hips and prevent the patient from sliding toward the head end of the patient support surface when the patient support surface is tilted in a Trendelenburg position. The method includes tilting the patient support surface into a Trendelenburg position.

In accordance with a further aspect of the present invention, an apparatus for restraining a patient in a Trendelenburg position includes a padded portion configured to engage a patient's hip. The connector portion is coupled between the padded portion and the patient support adjustable to permit movement of the padded portion relative to the patient support. The padded portion engages the hip to provide a force vector at the hip away from the head end of the patient support. In a preferred embodiment, there will be a padded portion on each side of the patient to engage the patient's hips to prevent movement to the head end of the support.

Additional features and advantages of the invention will become apparent to those skilled in the art upon consideration of the following detailed description of the preferred embodiment exemplifying the best mode of carrying out the invention as presently perceived.

BRIEF DESCRIPTION OF DRAWINGS

The present invention will be described hereafter with reference to the attached drawings which are given as non-limiting examples only, in which.

DETAILED DESCRIPTION OF THE DRAWINGS

The hip brace assemblies of the present invention include padded hip braces that are configured to engage the hip portion of a patient's pelvic area and thereby prevent movement of the patient on a support that is tilted in a Trendelenburg position. The padded hip braces are configured to engage any portion of the hip or, specifically, the top portion (iliac crest) of the hip. Further, the padded hip braces are coupled to adjustable positioning assemblies that are removably and adjustably coupled to the side rails of surgical tables and other patient support devices.

Figure 1:
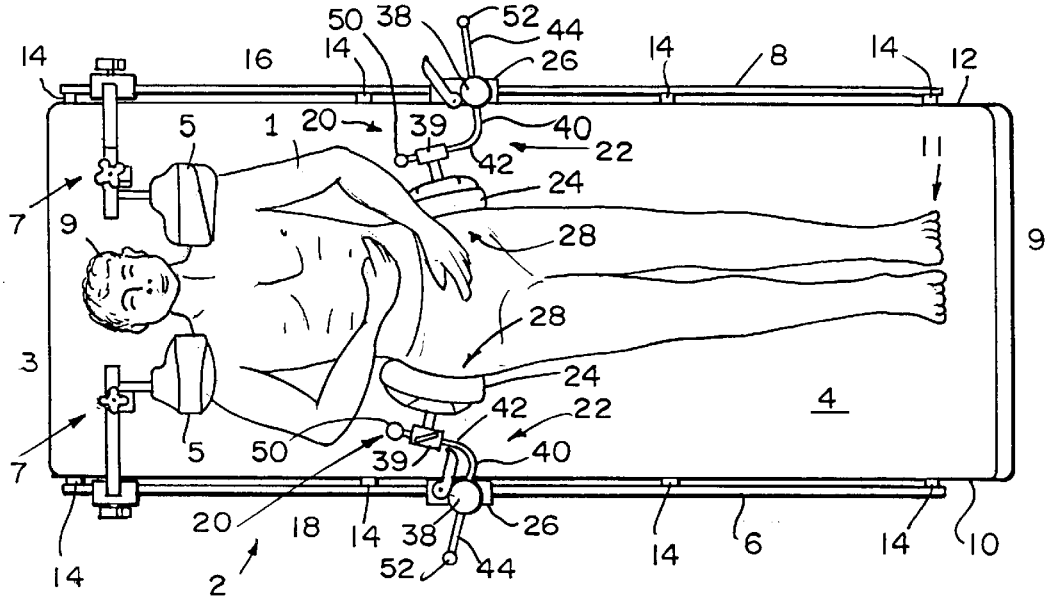
FIG. 1 is a top view of a patient laying flat on a surgical table support surface that is tilted in the Trendelenburg position which depicts the patient held in position by optional shoulder brace assemblies and hip brace assemblies.

A top view of a patient laying flat on a surgical table support surface that is tilted in a Trendelenburg position is shown in FIG. 1. The patient is held into position by hip brace assemblies 20 and optional shoulder brace assemblies. The surgical table 2 depicted in FIG. 1 includes a patient support surface 4 and accessory attachment rails 6 and 8 that extend along edges 10 and 12. The patient support surface 4 has a rectangular shape, with accessory attachment rails 6 and 8 located adjacent the longitudinal sides 16 and 18 thereof. Accessory attachment rails 6 and 8 are of conventional design, having rectangular cross sections of standard dimensions. In addition, accessory attachment rails 6 and 8 are spaced apart from the edges 10 and 12 of the patient support surface 4 by a plurality of spacers 14 that are coupled to a frame or deck 66 upon which the patient support surface 4 is supported (see also FIGS. 2, 3 and 7). Patient support surface 4 further includes a head end 3 and a foot end 9. The hip brace assemblies 20 of the present invention may be used in combination with optional shoulder brace assemblies 7 that include shoulder braces 5. Such shoulder brace assemblies 7 are attached to the accessory attachment rails 6 and 8 as depicted.

Figure 2:
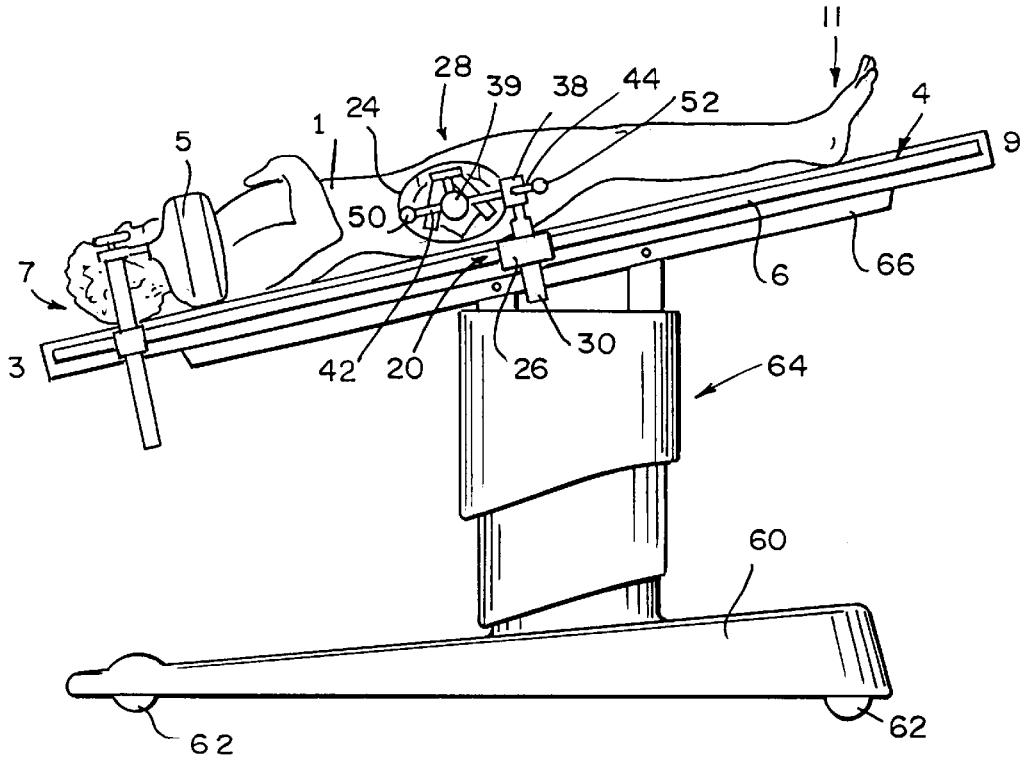
FIG. 2 is a side view of the patient and surgical table of FIG. 1 that depicts the manner in which the patient is tilted in the Trendelenburg position.

The manner in which the patient is tilted in a Trendelenburg position is shown in FIG. 2. In the Trendelenburg position, patient support surface 4 is tilted so that patient's head 9 is lower than patient's feet 11. In this position, there is a tendency for the patient's body to slide on patient support surface 4 toward head end 3 of surgical table 2. Although shoulder braces 5 are used to prevent patient 1 from sliding toward the head end 3 of the surgical table 2, the use of shoulder braces 5 alone tends to distribute all the force necessary to hold the patient 1 in position onto the patient's shoulders. This can become a problem, particularly, if the patient 1 has a shoulder or back injury, or if the shoulder braces 5 interfere with a surgical procedure that is to be performed. Otherwise, the use of shoulder braces 5 alone creates forces along the patient's torso, including the patient's spine, chest cavity, etc., which may be undesirable. The surgical table 2 further includes abase 60 with casters 62, an upper deck or frame 66 that supports patient support surface 4, and an intermediate frame or pedestal 64 that is coupled between base 60 and upper deck or frame 66. In FIG. 2, it can be seen how the posts 30 of the hip brace assemblies 20 extend through the rail clamps 26 perpendicular to the patient support surface 4.

Figure 3:
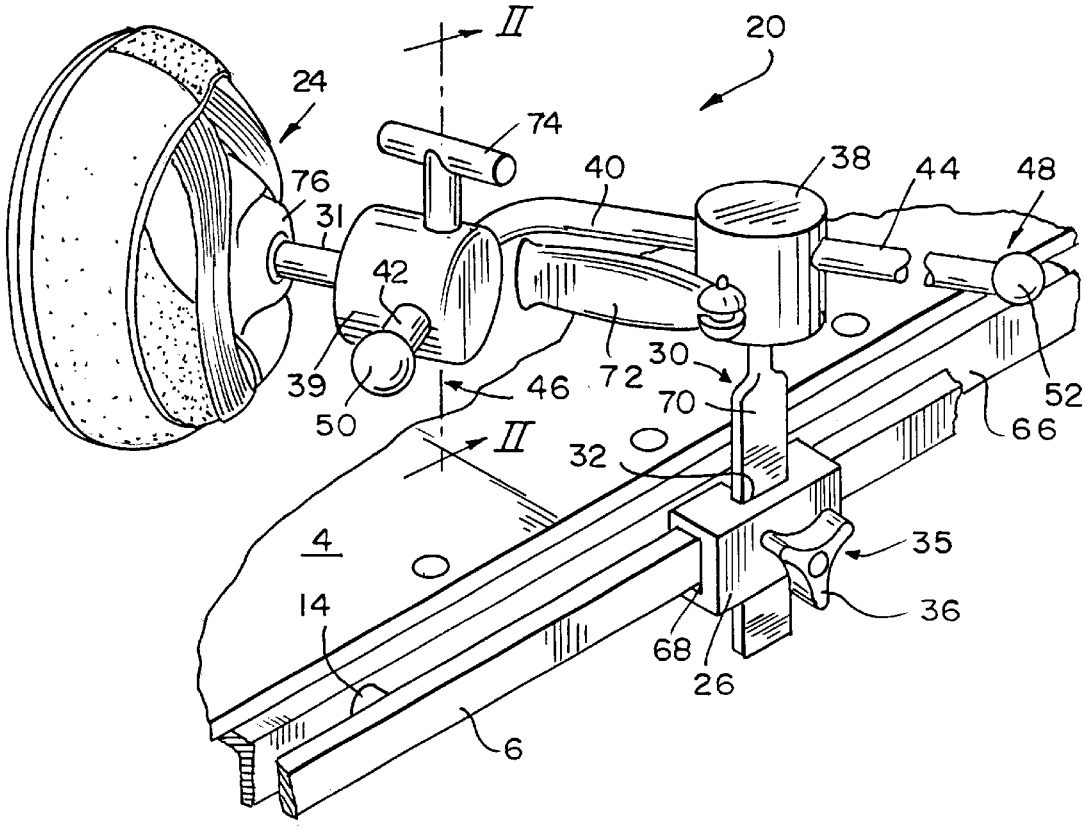
FIG. 3 is a perspective view of one of the hip brace assemblies used in FIG. 1.

Hip brace assemblies 20 include adjustable positioning assemblies 22 and/or padded hip braces 24, as shown in FIGS. 1 through 3. Hip brace assemblies 20 are adjustably coupled to adjustable positioning assemblies 22 which include rail clamps 26. Rail clamps 26 are coupled to the accessory attachment rails 6 and 8 adjacent a patient's pelvic area 28. Posts 30 are received in apertures 32 provided in the rail clamps 26. Posts 30 are adjusted and fixed at a desired height relative to the patient support surface 4 by tightening threaded fasteners 35 that are provided with grippable knobs 36 further discussed hereinafter below.

Padded hip braces 24 are contoured and designed to engage the top side portions of a patient's pelvic area 28 on either side of the patient's body. Such engagement will counteract forces that tend to cause the patient 1 to slide toward the head end 3 of the surgical table 2. Thus, when the hip brace assemblies 20 of the present invention are used alone, the force necessary to prevent the patient from sliding toward the head end 3 of the surgical table 2 will be applied to the patient's pelvic area 28 by the padded hip braces 24. This will prevent compression forces from acting on the patient's torso, including the patient's spine, chest cavity, etc.

A perspective view of one of the hip brace assemblies 20 used of FIG. 1 is shown in FIG. 3. The rail clamp 26 includes a channel 68 that receives accessory attachment rail 6. Accessory attachment rail 6 is secured to support frame or deck 66 by spacers 14. Patient support surface 4 is supported by support frame or deck 66. Post 30, that couples first ball joint assembly 38 to accessory attachment rail 6, has a lower rectangular cross-sectional shaped portion 70 and is received in a corresponding rectangular cross-sectional shaped aperture 32 formed in the rail clamp 26. As discussed above, post 30 is adjusted and fixed at a desired height relative to the patient support surface 4 by tightening threaded fastener 35 that is provided with a grippable knob 36 (see also FIG. 8).

First and second ball joint assemblies 38, 39 are fastened to rail clamp 26, as shown in FIG. 3. In this illustrated embodiment, angled support bar 40 extends through first and second ball joint assemblies 38, 39. The angled support bar 40 includes two legs 42 and 44. The ends 46 and 48 of the angled support bar 40 are provided with sphere-shaped structures 50 and 52. The sphere-shaped structures 50 and 52 are large enough to prevent the ends 46 and 48 of the angled support bar 40 from being slid out of the first and second ball joint assemblies 38,39. The sphere-shaped structures 50 and 52 are used to grasp and position the angled support bar 40. Leg 44 of the angled support bar 40 passes through the first ball joint assembly 38. Leg 42 of the angled support bar 40 passes through the second ball joint assembly 39. Second ball joint assembly 39 is coupled to padded hip braces 24 by post 31 discussed below. First ball joint assembly 38 includes a hand lever 72 that can be manually operated to lock both post 30 and support bar 40 into desired positions and orientations with respect to the first ball joint assembly 38. Likewise, the second ball joint assembly 39 includes a hand lever 74 that can be manually tightened to lock both the support bar 40 and padded hip brace 24 into desired positions and orientations with respect to the second ball joint assembly 39.

In use, a patient is laid in position on a patient support surface 4, and hip brace assemblies 20 of the present invention are attached to accessory attachment rails 6 and 8 adjacent both sides of the patient's pelvic area. Next, the first and second ball joint assemblies 38 and 39 are unlocked and the padded hip braces 24 are positioned against the top side portions of the patient's pelvic area 28 to prevent the patient from sliding toward the head of the patient support surface (see FIG. 2). Once the padded hip braces 24 are position, the first and second ball joint assemblies 38 and 39 are locked in position. Optional shoulder brace assemblies 7 can then be installed before the patient is tilted into the Trendelenburg position, or after the patient is tilted into an initial Trendelenburg position having a small angle of inclination. It is possible to adjust the distribution of forces that act on the padded hip braces 24 and the shoulder braces 5 by adjusting the padded hip braces 24, and then tilting the patient into an initial Trendelenburg position before adjusting the shoulder braces 5. It is appreciated that the above-described procedure can be applied to hip brace assemblies 20 or any other assemblies within the scope of the invention.

Figure 4:
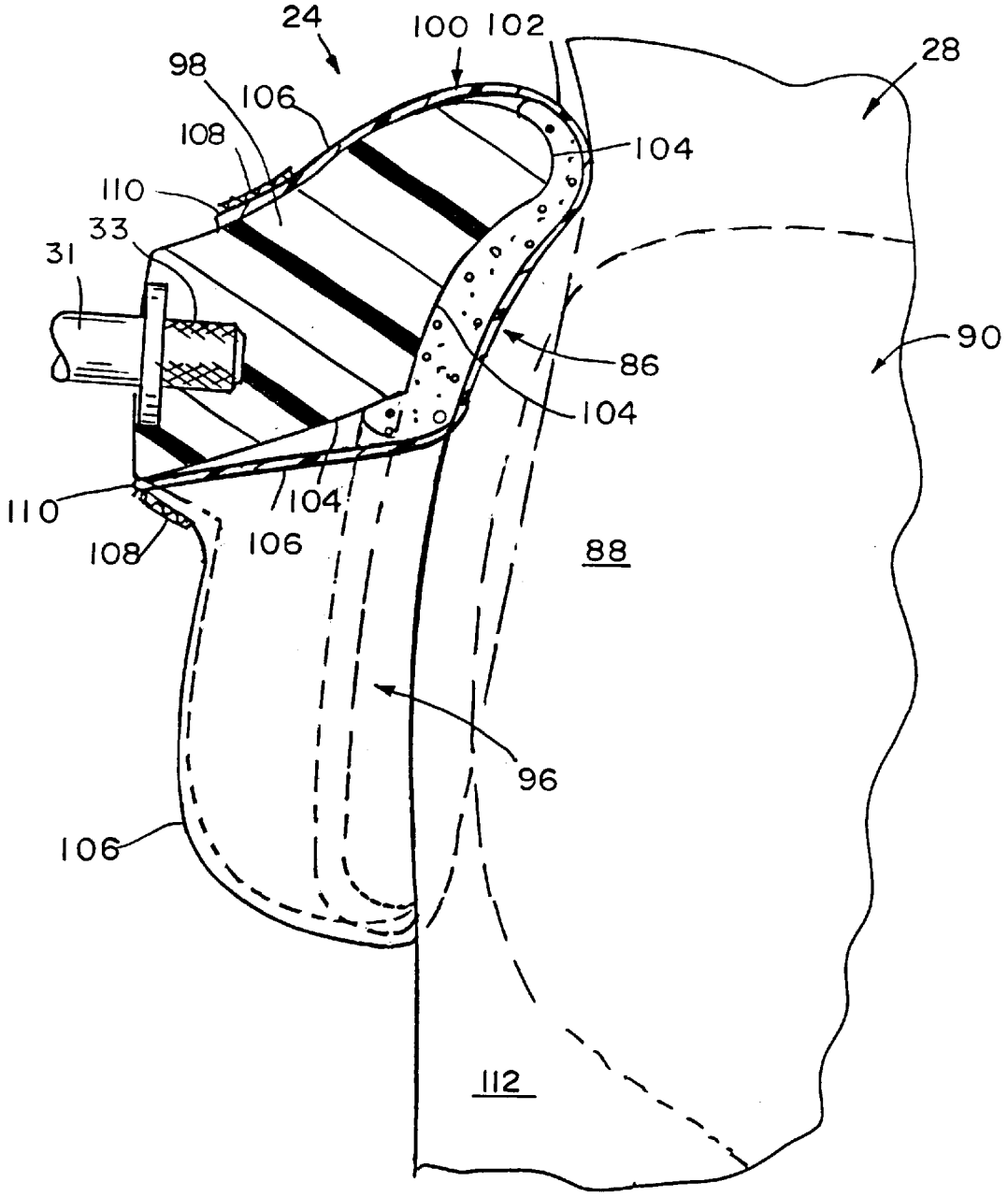
FIG. 4 is a cross-section view of a padded hip brace according to another embodiment of the present invention positioned against a portion of a patient's pelvic area.
Figure 5:
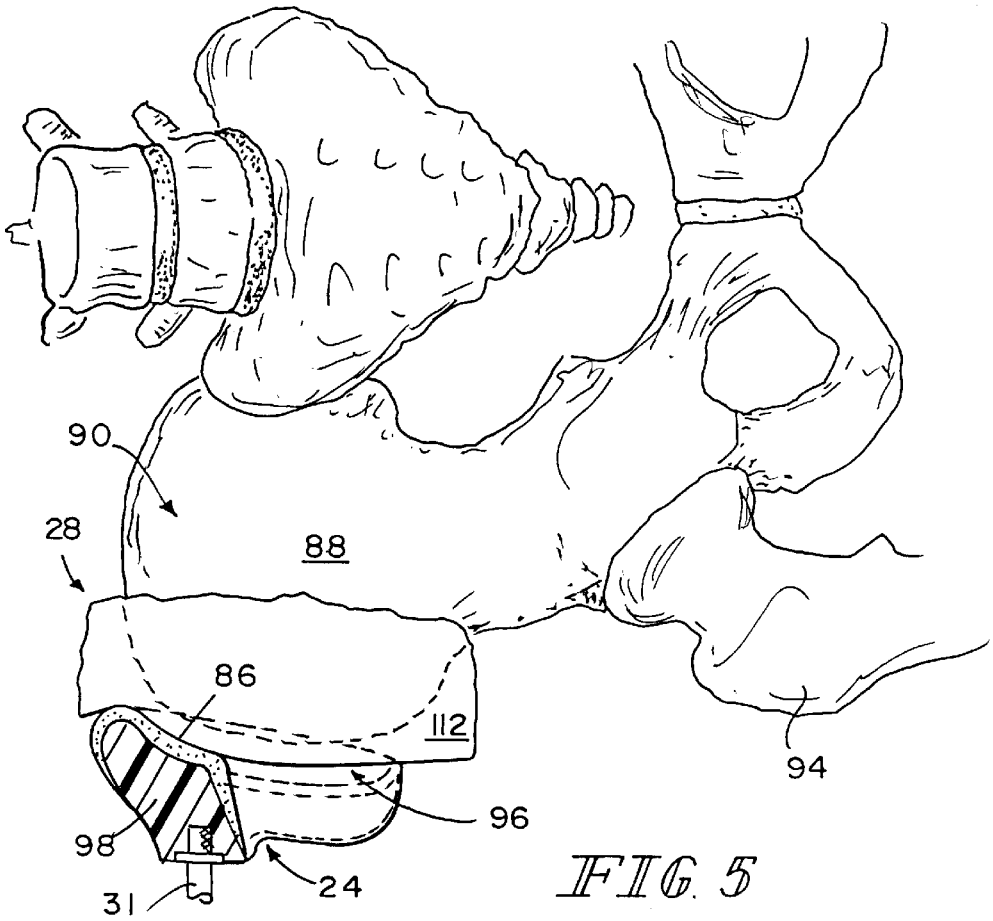
FIG. 5 is another cross-section view of the padded hip brace of FIG. 4 positioned against a top portion of a patient's pelvic area.
Figure 6:
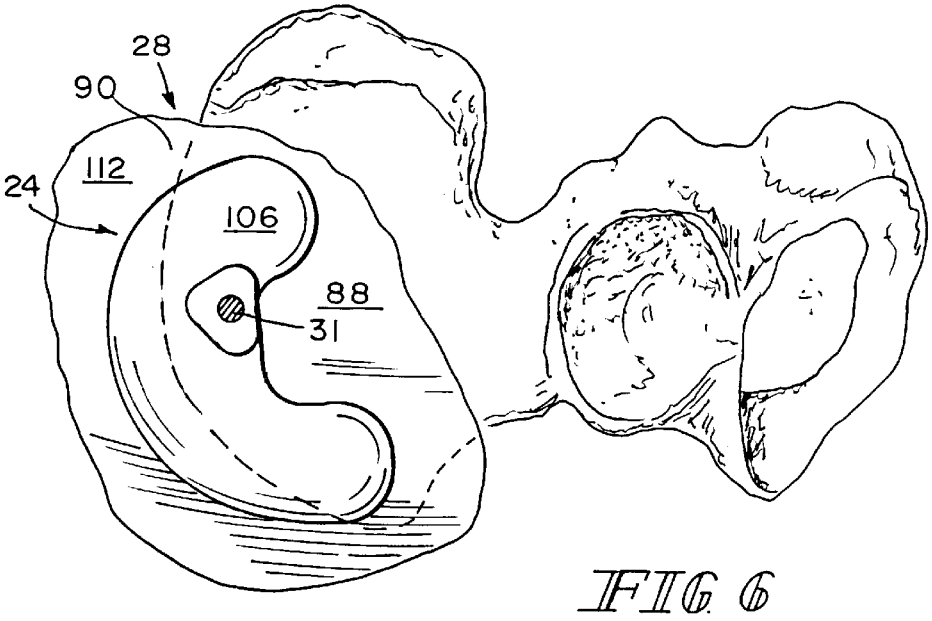
FIG. 6 is side elevation view of the padded hip brace of FIG. 4 positioned against the top portion of a patient's pelvic area.

A cross-sectional view of another embodiment of the present invention is shown in FIGS. 4 through 7. Each padded hip brace 24 is a generally "C"-shaped pad positioned against a patient's pelvic area 28. A face 86 is contoured to the lateral surfaces 88 of a patient's pelvic area 28 which includes the pelvis 90, hip joint 92 and femur 94, as shown in FIGS. 5 and 6. The center of the face 86 has partially conical shape 96 contoured and positioned on the widest top portion of a patient's pelvic area or hip, so as to engage the patient. The contoured pad base 98 of padded hip brace 24 is made from a rigid or semi-rigid polymer material. Post 31 is attached to the contoured pad base 98 by an end there of which is embedded into the body of the contoured pad base 98. The contoured pad base 98 can be molded onto end 33 of post 31, or otherwise glued onto the end 33 of post 31. The end 33 of post 31 can be provided with a roughened surface as depicted to aid in the attachment of contoured pad base 98 thereon.

Figure 7:
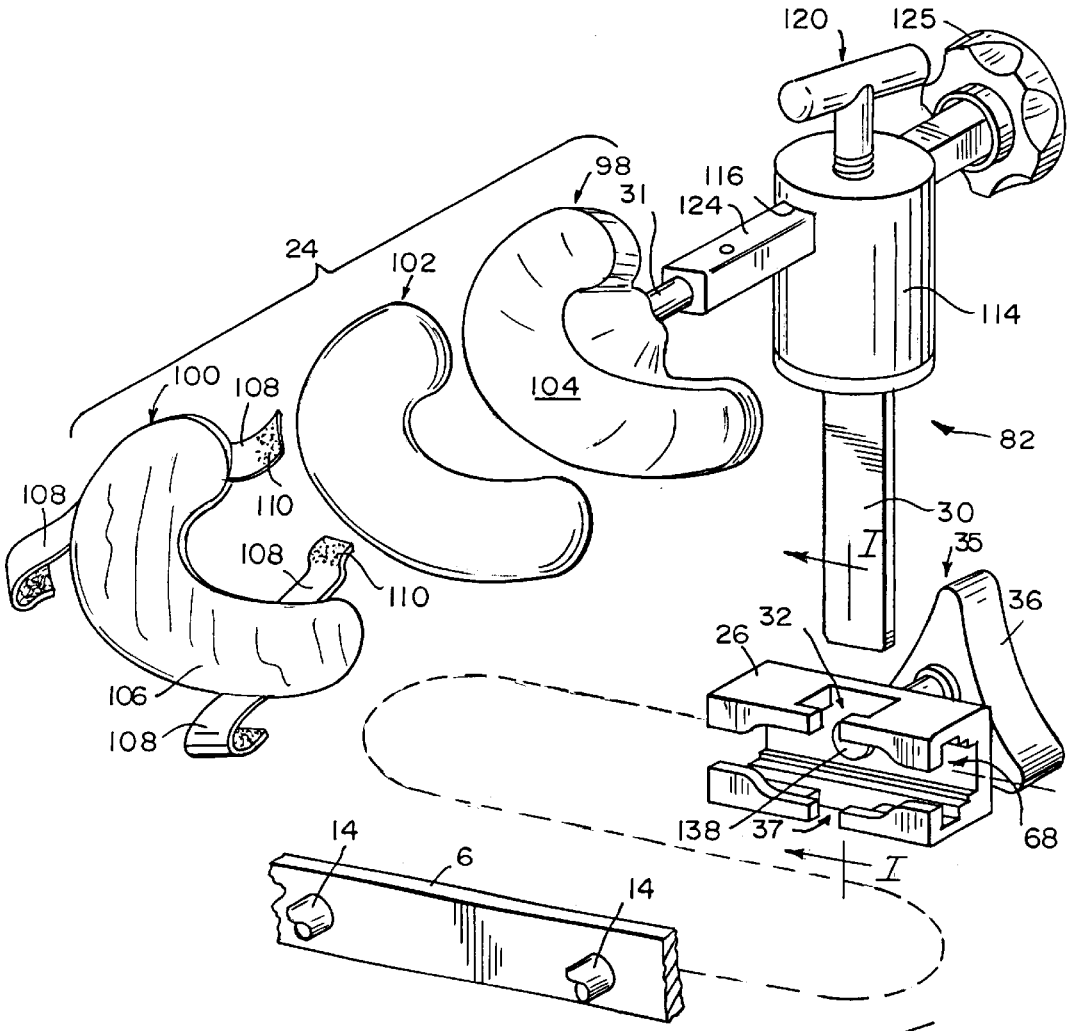
FIG. 7 is a partially exploded perspective view of a hip brace assembly having the hip brace of FIG. 4.

Padded hip braces 24 also include removable padded covers 100 and a layer of polyfoam material or airgel 102 that wraps over the peripheral edges 104 of the contoured pad bases 98, as best shown in FIGS. 4 and 7. The removable padded covers 100 comprise outer fabric layers 106 which cover the layer of polyfoam material 102. Stretchable or elastic straps 108 attached to the outer surface of the padded covers 100 are used to secure the removable padded cover 100 over the contoured pad bases 98. In the illustrated embodiment, velcro fasteners 110 are attached to the ends of straps 108 and configured to couple together to secure cover 100 over the polyfoam material 102. This configuration allows padded hip braces 24 to provide a snug yet comfortable fit against body 112.

A joint assembly 82 comprising padded hip brace 24 is shown in FIG. 7. Joint assembly 82 includes a block 114 having a transverse bore 116 disposed therethrough and having a lock screw 120 extending transverse to bore 116. The end of lock screw 120 (not shown) is threaded and configured to engage post 124 to tighten or loosen the same. Post 124 is coupled to post 31 which is connected to padded hip brace 24. A grip 125 is provided on post 124 at the end opposite padded hip brace 24. Grip 125 is sized large enough to prevent post 124 from being slid out from joint block 114, and is useful as a handle to adjust hip brace 24. Post 30 is received in block 114. As previously discussed, post 30 has a rectangular cross-sectional shape which is received in the corresponding rectangular cross-sectional shaped apertures 32 and 37 formed in rail clamp 26.

Figure 8:
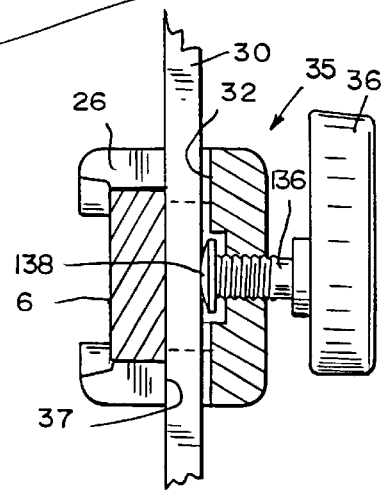
FIG. 8 is a cross-section view of a rail clamp along the line of I—I of FIG. 7.

As shown in FIG. 8, post 30 can be adjusted and fixed at a desired height relative to the patient support surface 4 by tightening threaded fastener 35. Threaded pin portion 136 of threaded fastener 35 has a rounded end 138 that is forced adjacent post 30, holding same in the desired position. As previously discussed, threaded fastener 35 is provided with a grippable knob 36 to ease tightening and loosening.

Padded hip braces 24 are secured to posts 31 that are received by the second ball joint assemblies 39. Suitable ball joint assemblies that can be used for the first and second ball joint assemblies 38 and 39 are available from The O.R. Group Inc. of Acton, Mass., and depicted in their Fall 1999 "O.R. Direct Surgical Table Accessories" catalog where they are used in conjunction with a number of products, including lateral braces. The first ball joint assemblies 38 allow for rotational and pivotal adjustment of the hip brace assemblies 20 with respect to posts 30, which are in turn vertically adjustable, as noted above. The second ball joint assemblies 39 allow for rotational and pivotal adjustment of either padded hip braces 24 with respect to the hip brace assemblies 20. Thus, it is possible to adjust and fix the position of padded hip braces 24 on either side of patient 1 so that padded hip braces 24 engage the top side portions of patient's pelvic area 28 and prevent longitudinal movement toward head end 3 of the surgical table 2, as previously discussed.

Figure 9:
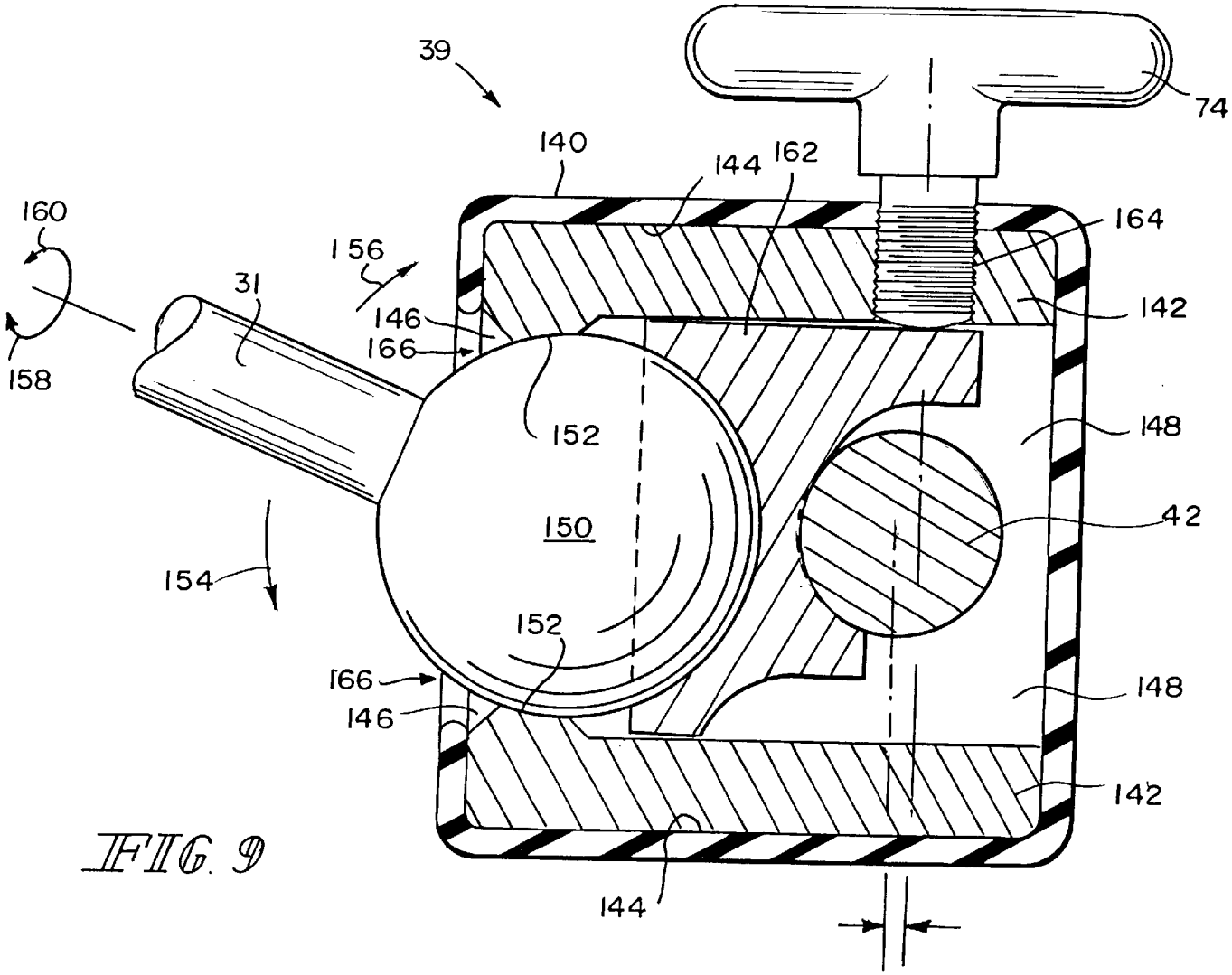
FIG. 9 is a cross-section view of a ball joint assembly along the line of II—II of FIG. 3.

Second ball joint assembly 39 comprises a housing 140 containing an inner frame 142. (See FIG. 9.) Frame 142 is positioned about the inner periphery 144 of housing 140 and includes an aperture portion 146 and a bore portion 148. Aperture portion 146 is sized to hold ball 150 in place at contacts 152. Ball 150 is free to rotate in directions 154, 156, 158 and 160 within the confines of aperture 146. Bore 148 is configured to receive an insert 162 and leg 42. Threaded end 164 of hand lever 74 extends through housing 140 and frame 142 to engage insert 162. As threaded end 164 extends into housing 140, a force is applied to insert 162. This force in turn applies a force against both ball 150 and leg 42, preventing them from moving, fixedly securing same into place. This ensures ball 150 and leg 42 can be fixed into a desired position. Post 31 extends from ball 150 through an aperture 166 disposed through housing 140 coaxially aligned with aperture 146 of frame 142.

The hip brace assemblies of the present invention can be used alone or in combination with shoulder braces. When used alone, the hip brace assemblies of the present invention apply the force necessary to prevent a patient from sliding toward the head end of a patent support device, the assembly comprising the padded hip braces which contact the patient's pelvic area.

In addition, the hip braces of the present invention are not limited for use in conjunction with surgical tables or surgical procedures. In this regard, it is to be understood that the hip braces can be used in conjunction with a variety of hospital beds, carts, therapy beds and other patient support devices that are designed to tilt a patient in a head-down manner.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. An apparatus for restraining a patient lying supine in a Trendelenburg position on a patient support surface which comprises:

a patient support surface which is tiltable and includes a head end, a foot end and opposed sides which extend between the head end and the foot end;

a pair of padded hip braces positioned inward from the sides of the patient support at an intermediate location between the head end and foot end thereof, wherein each of the pair of padded hip braces is coupled to an opposite side of the patient support surface by an adjustable positioning assembly, wherein the padded hip braces are curved inward toward one another and are contoured to engage an outside top portion of the patient's hips in order to prevent the patient from sliding toward the head end when the patient support surface is tilted in a Trendelenburg position.

2. The apparatus for restraining a patient in a Trendelenburg position according to claim 1, wherein the adjustable positioning assembly includes at least one ball joint assembly.

3. The apparatus for restraining a patient in a Trendelenburg position according to claim 2, wherein the at least one ball joint assembly comprises a pair of ball joint assemblies.

4. The apparatus for restraining a patient in a Trendelenburg position according to claim 3, further comprising a support bar between each of the pair of ball joint assemblies.

5. The apparatus for restraining a patient in a Trendelenburg position according to claim 4, wherein the support bar comprises an angled support bar.

6. The apparatus for restraining a patient in a Trendelenburg position according to claim 5, wherein each end of the angled support bar passes through one ball joint assembly of the pair of ball joint assemblies.

7. The apparatus for restraining a patient in a Trendelenburg position according to claim 6, wherein one of the ball joint assemblies is coupled to one of the padded hip braces and the other of the ball joint assemblies is coupled to the patient support surface by a movable clamp.

8. The apparatus for restraining a patient in a Trendelenburg position according to claim 7, further including a rail along each of the opposed sides of the patient support surface and wherein the movable clamp is coupled to one of the rails.

9. The apparatus for restraining a patient in a Trendelenburg position according to claim 1, further comprising a pair of shoulder braces which are positioned near the head end of the patient support surface for abutting against the patient's shoulders.

10. The apparatus for restraining a patient in a Trendelenburg position according to claim 1, wherein each of the pair of padded hip braces include a contoured pad base and a padded cover.

11. The apparatus for restraining a patient in a Trendelenburg position according to claim 10, wherein each of the contoured base pads includes a mounting post.

12. The apparatus for restraining a patient in a Trendelenburg position according to claim 1, wherein the patient support surface is a surgical table.

13. A method for restraining a patient lying supine in a Trendelenburg position on a patient support surface which comprises:

positioning a patient in a supine position on a tiltable patient support surface having a head end; and engaging an outside top portion of each of the patient's hips on the upper side of the patient's hips with padded hip braces curved inward toward one another and contoured to engage the outer top portion of the patient's hips in order to prevent the patient from sliding toward the head end of the tiltable patient support surface when tilted in the Trendelenburg position.

14. The method for restraining the patient in the Trendelenburg position according to claim 13, further comprising engaging the patient's shoulders with shoulder braces.

15. The method for restraining the patient in the Trendelenburg position according to claim 14, wherein the step of engaging the patient's shoulders with shoulder braces is performed after the patient support is tilted to an intermediate Trendelenburg position.

* * * * *